United States Patent [19]

Axelrod et al.

[11] Patent Number: 4,657,562

[45] Date of Patent: Apr. 14, 1987

[54] COLD FLOW IMPROVING FUEL ADDITIVE COMPOUND AND FUEL COMPOSITION CONTAINING SAME

[75] Inventors: Joan C. Axelrod, Media, Pa.; Sheldon Chibnik, Cherry Hill, N.J.

[73] Assignee: Mobil Oil Corporation, New York, N.Y.

[21] Appl. No.: 789,815

[22] Filed: Oct. 21, 1985

[51] Int. Cl.[4] ..... C10L 1/22

[52] U.S. Cl. ..... 44/71; 260/404.5

[58] Field of Search ..... 260/404.5; 44/71

[56] References Cited

U.S. PATENT DOCUMENTS

| | | | |
|---|---|---|---|
| 2,606,890 | 8/1952 | Polly et al. | 260/405.5 |
| 3,962,104 | 6/1976 | Swietlik et al. | 252/32.7 E |
| 4,108,613 | 8/1978 | Frost, Jr. | 44/72 |
| 4,283,314 | 8/1981 | Zeilstra et al. | 524/567 |
| 4,297,107 | 10/1981 | Boehmke | 44/71 |
| 4,491,455 | 1/1985 | Ishizaki et al. | 44/62 |
| 4,498,908 | 2/1985 | Chibnik | 44/71 |
| 4,509,954 | 4/1985 | Ishizaki et al. | 44/71 |

*Primary Examiner*—Mrs. Y. Harris-Smith

*Attorney, Agent, or Firm*—Michael G. Gilman; Alexander J. Gilman McKillop; Howard M. Flournoy

[57] ABSTRACT

The product of reaction between a branched chain monocarboxylic acid amide, an epoxide and a carboxylic acid when added to a hydrocarbyl distillate fuel in minor effective amounts provides a fuel composition having improved cold flowability.

20 Claims, No Drawings

COLD FLOW IMPROVING FUEL ADDITIVE COMPOUND AND FUEL COMPOSITION CONTAINING SAME

BACKGROUND OF THE INVENTION

The present invention is directed to hydrocarbyl fuel compositions having improved low temperature characteristics. More particularly, it is directed to such compositions having a major amount of a suitable distillate fuel and a minor effective amount of an additive compound consisting of the reaction product of an amide derivative of a branched-chain monocarboxylic acid having at least one tertiary-amine group, an epoxide and a carboxylic acid and to said additive compounds.

It is well known that distillate fuels such as diesel fuels are subject to poor flowability at low temperatures and have relatively high cold filter plugging points. Many expedients have been attempted in the prior art to overcome these adverse cold temperature properties.

U.S. Pat. No. 4,108,613 teaches the use of a mixture of (1) the reaction product of an epoxidized alpha-olefin with a nitrogen-containing compound selected from ammonia, an amine, a polyamine or a hydroxyamine and (2) an ethylene-olefin copolymer as an additive to depress the pour point of hydrocarbonaceous fuels and oils.

U.S. Pat. No. 3,962,104 discloses lubricating oil compositions containing minor amounts of quaternary ammonium salts useful as an oil improving additives. The quaternary ammonium salts utilize a cation derived from the reaction product of one molar proportion of a tertiary amine with one or more molar proportions of an olefin oxide and an amount of water in excess of stoichiometric. The anion is derived from an organic acid and the tertiary amine has substituents which are alkyl, alkenyl, substituted alkyl, substituted alkenyl, aromatic or substituted aromatic groups.

None of these prior art materials utilize the specific branched chain acid reaction products as described below or provide a breakthrough in cold flow plugging point and pour point depression of distillate fuels to ensure the desired performance at low temperatures. Additionally, the materials in accordance with the invention are applicable to a wide variety of distillate (diesel) fuels whereas presently commercially available additive materials are more specific and generally work for only one or two particular fuels, not over a broad range of available fuels.

SUMMARY OF THE INVENTION

Applicants have now discovered novel fuel additive compounds useful in improving the low temperature characteristics of distillate fuel compositions, which compositions comprise a major proportion of a liquid hydrocarbyl distillate fuel and a minor proportion, effective to improve low temperature characteristics such as pour point and filterability, of said additive compounds consisting of the reaction product of (1) an amide derivative of a branched chain monocarboxylic acid having at least one tertiary amine group, (2) an epoxide and (3) additional carboxylic acid and to said compositions and a method of reducing the pour point and CFPP thereof.

DETAILED DESCRIPTION

The present invention is directed to improved low temperature distillate fuel compositions comprising said fuel and the described additive product or compound which, when added to the distillate fuel in cold flowability effective amounts, significantly decreases the cold flow plugging point (CFPP) as well as the pour point of the fuel to which it is added. Suitable fuels include, but are not limited to, diesel fuel, home heating oil, airplane jet fuel and the like.

The additive providing these properties is a product of reaction formed by (1) the reaction of an amide derivative of a branched chain monocarboxylic acid having at least one t-amine group, (2) an epoxide and (3) additional carboxylic acid. The invention is therefore directed also to the additive products of reaction themselves. The additional carboxylic acid may be the same branched chain carboxylic acid or a different branched chain acid or a linear carboxylic acid. When added to a hydrocarbyl distillate fuel, these additive products significantly decrease the fuel's pour point as well as its cold flow plugging point below the temperatures obtained by additives utilized in the prior art. The additive product of reaction in accordance with the present invention is therefore the reaction product of a branched chain monocarboxylic acid amide which contains a tertiary amine, an epoxide and a carboxylic acid.

The preferred branched chain carboxylic acids are telomer acids which may be prepared by the free radical addition of one mole of acetic anhydride to at least 3 moles of hexene and/or a higher olefin having up to about 30 or more carbon atoms ($C_{30}^{+}$) in the presence of a trivalent manganese compound. This invention is not, however, limited to any specific method of preparing the telomer acids. Any method known in the art may be used. Preferred telomer acids are those made from $C_{10}$–$C_{20}$ alpha olefins and manufactured under the trade name Kortacid through Akzo Chemie, Chicago, Ill. Specific acids are identified for example as Kortacid T-1801, Kortacid T-1001 and the like. The first two digits give the number of carbon atoms in at least one side chain of the acid. More specifically it is noted that the monocarboxylic acid having the below structural formula is known and further identified as a telomer acid and may be formulated in accordance with a procedure provided in U.S. Pat. No. 4,283,314 in which a compound having the same structural formula and meanings is disclosed. U.S. Pat. No. 4,283,314 is incorporated herein by reference.

Independent of the molecular weight, it is particularly preferred that the branched chain monocarboxylic acid have the structural formula

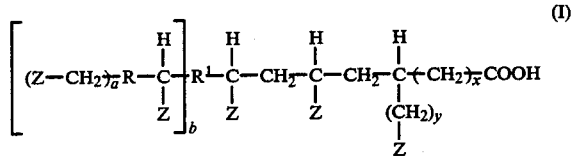

(I)

where Z is $-(CH_2)_nCH_3$ where n is an integer of from about 3 to about 42; x and y are different and are either 0 or 2; a is 0 or 1, if a is 0, R is hydrogen but if a is 1, R is $-CH_2$; and b is 0 or 1, if b is 0, $R^1$ is hydrogen but if b is 1, $R^1$ is $-CH_2$.

The epoxides useful herein generally contain from 2 to about 18 carbon atoms. The epoxides may be substituted with an aromatic or a saturated or unsaturated aliphatic group. Among the preferred epoxides that may be used in the present invention are ethylene oxide, propylene oxide, styrene oxide, 1,2-epoxybutane, decene epoxide, tetradecene epoxide and octadecene epoxide and the like. It is emphasized that the above list is non-limiting. Any other epoxides, within the preferred group of epoxides having 2 to 18 carbon atoms may be advantageously used.

The amide derivative reaction product may be classified by the generic formula $$R^2CON(R^3)R^4N(R^5)(R^6)$$

where $R^2$ is a branched chain monocarboxylic acid radical having a molecular weight of between about 300 and 1,000; $R^3$ is hydrogen or $C_1$–$C_{25}$ alkyl; $R^4$ is hydrocarbyl of 1 to 25 carbon atoms; and $R^5$ and $R^6$ are the same or different and are $C_1$–$C_{25}$ alkyl.

Generally speaking, the branched chain monocarboxylic acid having a molecular weight of about 300 to 1,000 may be reacted as disclosed below with a suitable diamine to produce the above described amide derivative. In a more preferred embodiment of the present invention, the branched chain monocarboxylic acid has a molecular weight of 400 to 900. Still more preferably, the molecular weight of the branched chain monocarboxylic acid is in the range of between 500 and 800.

The amide derivatives may be formed by a simple reaction between the acid and a suitable diamine such as $$RCO_2H + H_2N{-}CH_2CH_2CH_2N(CH_3)_2 \rightarrow RCO{-}NH_2{-}CH_2CH_2CH_2N(CH_3)_2 \rightarrow RCO{-}NH{-}_2{-}CH_2CH_2CH_2N(CH_3)_2$$

where R is a telomer acid radical. Any suitable diamine may be used and any conventional process known to the art may be used to provide the amide derivative. The amide derivative is thereafter reacted with an epoxide and additional carboxylic acid and is further defined by the branched chain hydrocarbyl having a molecular weight of between about 300 and 1,000 $R^2$. $R^2$, in a preferred embodiment, has the structural formula

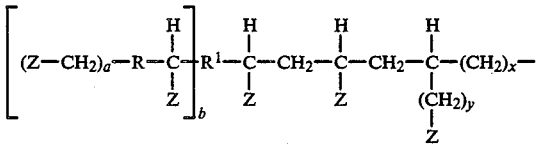

where Z, R, $R^1$, n, a, b, x and y have the meanings given for structure (I).

Some of the useful diamines include but are not limited to N-(3-aminopropyl)morpholine, N-(2-aminoethyl)morpholine, N-(2-aminopropyl)morpholine, N,N'-bis(3-aminopropyl)piperazine, N,N-diethylethylenediamine, 3-dimethylaminopropylamine, unsymmetrical (unsym.) dimethylethylenediamine, N,N-dimethyl-N'-ethylethylenediamine and the like and mixtures of two or more of these. Especially preferred is 3-dimethylaminopropylamine. All the R groups mentioned are alkyl, nevertheless, others can be alkenyl, aryl, alkaryl, aralkyl or cycloalkyl. If aryl the group will contain 6 to 14 carbon atoms. The amines may be obtained as articles of commerce or prepared in any convenient manner.

The product of reaction of (1) an amide derivative of a telomer acid, (2) an epoxide and (3) additional carboxylic acid has been surprisingly found to improve the cold temperature performance of distillate fuels such as diesel fuels, residential fuel oils, aviation jet fuels and the like. This improved performance is manifested by significantly decreased pour point and cold filter plugging point (CFPP) temperatures for fuels to which additives/compounds of the present invention are added.

The various reactants are usually reacted in substantially stoichiometric amounts or equimolar amounts, however, a slight molar excess of telomer acid to other reactants may be used if desired at temperatures ranging from about 50°–175° C. at pressures determined by the specific reaction, i.e., autogenous in 0.5 to about 3 hours or more. It is to be understood that when the amide derivative is reacted with the epoxide and additional carboxylic acid, said additional carboxylic acid may also be a branched chain acid which may be a telomer acid that is different or the same as the acid from which the amide derivative is prepared or a linear monocarboxylic acid. The additional carboxylic acid has up to 20 or more carbon atoms, preferably 10–20.

The improved cold flow effect manifested by the additives of the present invention to distillate fuels is accomplished by providing an effective cold flow improving amount of the additive compound of the present invention to a distillate fuel. More preferably, the amount added to the distillate fuel is in the range of between about 0.01 and 3–5 percent by weight, based on the total weight of the fuel composition. Still more preferably, the concentration of the flow improving product of reaction of the present invention to the distillate fuel is in the range of between 0.02 and 2 percent by weight.

The following examples are given to illustrate the present invention. Since these examples are given for illustrative purposes only, the invention embodied therein should not be limited thereto.

EXAMPLE 1

Preparation of Amine Compound From Branched Chain Monocarboxylic Acid

Kortacid (trademark) T-1801, a branched chain monocarboxylic telomeric acid (obtained from AKZO Chemie) was reacted with 3-dimethylaminopropylamine as follows to produce the 3-dimethyl-aminopropylamide of Kortacid T-1801.

Equimolar amounts of Kortacid T-1801 (111.3 g, 0.164 moles) and 3-dimethylaminopropylamine (16.7 g, 0.164 moles) were heated in a stirred flask at 110°–115° C. in the presence of benzene solvent to azeotropically remove the water formed. After about two-thirds of the calculated amount of water was collected the solvent was distilled from the flask and the temperature was slowly raised to 150° C. and held for one hour. The reaction was stripped of volatile materials at 150° C. for one hour under full pump vacuum. The product was filtered through a bed of diatomite and solidified to a soft brown material on cooling.

EXAMPLES 2–7

Preparation of Cold Flow Improving Additive Products/Compounds

Example 2: 30.5 g. of the amide derivative formed in Example 1 was charged into a pressure vessel with 2.3 g. of propylene oxide and 27.0 g of Kortacid T-1801, representing equimolar amounts of the three reactants, and heated at 70°–100° C. until all the propylene oxide was reacted. Completion of the reaction was evidenced by loss of pressure. The pressure is autogenous, from unreacted propylene oxide, and depends on the temperature, amounts of materials present and vessel size. When the Rx (reaction) is done, pressure drops to 0 if all the propylene oxide is consumed (actually, the Rx is run under $N_2$ for safety, 2–5 psi of $N_2$ is left in the vessel at all times).

Example 3: 23.9 g of the compound of Example 1 was reacted with 4.9 g of 1,2-epoxydecane and 21.3 g of Kortacid T-1801.

Example 4: 24.4 g of the compound of Example 1, 3.8 g of styrene oxide and 21.7 g of Kortacid T-1801 were reacted in a pressure vessel at a temperature of 90°–100° C.

Example 5: 25.2 g of the compound of Example 1, 2.4 g of 1,2-epoxybutane and 22.4 g of Kortacid T-1801 were reacted at a temperature of 70°–100° C.

Example 6: 23.1 g of the compound of Example 1, 6.4 g of commercial grade tetradecene epoxide and 20.5 g of Kortacid T-1801 were reacted at a temperature of 70°–100° C.

Example 7: 22.3 g of the compound of Example 1, 7.8 g of commercial grade octadecene epoxide and 19.9 g of Kortacid T-1801, were reacted at a temperature of 70°–100° C.

Example 5 was otherwise run as Ex. 2. All the rest (Examples 3, 4, 6 and 7) have boiling points of about 125° C. and were run in an open flask at 125° C. until the reaction was complete (disappearance of epoxide band in infrared). This usually took from about 0.5–1.5 hours, depending on the reactivity of the epoxide.

EVALUATION OF ADDITIVE PRODUCTS

The products made in accordance with Examples 2–7 were each blended in a typical Diesel fuel (described in Table 1) in a concentration of 0.05% by weight, based on the total weight of the Diesel fuel composition. Each of the thus modified fuel compositions were tested to determine their pour point, in accordance with ASTM Test Procedure D-99, and filterability, in accordance with the Cold Filter Plugging Point (CFPP) test, IP 309/76.

In determining the Cold Filter Plugging Point of a distillate fuel, the fuel sample is cooled under prescribed conditions and, at intervals of 1° C., a vacuum of 200 mm water gauge is applied to draw the fuel through a fine wire mesh filter. As the fuel cools below its cloud point, increasing amounts of wax crystals will be formed. These will cause the flow rate to decrease and eventually complete plugging of the filter will occur. The Cold Filter Plugging Point is defined as the highest temperature (expressed as a multiple of 1° C.) at which the fuel, when cooled under the prescribed conditions, either will not flow through the filter or requires more than 60 seconds for 20 ml to pass through.

TABLE 1

| | | |
|---|---|---|
| Typical: | Distillation | °F. |
| Diesel | Initial | 366 |
| Fuel | 50° C. | 487 |
| | End | 663 |
| API Gravity | | 34.8 |
| Sulfur | | 0.17% |
| Aniline Point | | 130° F. |

COMPARATIVE EXAMPLE 1 (CE1)

The Diesel fuel with which the additive compounds of Examples 2–7 were blended was tested to determine its pour point and CFPP. The CE1 was tested in the absence of the additives of the present invention. The test was conducted in accordance with the procedures described above. The results of these tests are included in Table 2.

Table 2 clearly reveals that the additives in accordance with the invention dramatically lower both the pour point, and the cold filter plugging point.

TABLE 2

| Diesel Fuel Composition of Example No. | Epoxide Employed | Pour Pt, °F. | CFPP, °F. |
|---|---|---|---|
| CE1 | None | −10 | −3 |
| 2 | Propylene Oxide | −25 | −10 |
| 4 | Styrene Oxide | −30 | −12 |
| 5 | 1,2-Epoxybutane | −30 | −8 |
| 3 | $C_{10}$ Epoxide | −30 | −8 |
| 6 | $C_{14}$ Epoxide | −30 | −10 |
| 7 | $C_{18}$ Epoxide | −30 | −8 |

The improved low temperature characteristics of compositions (additives) in accordance with the invention is readily apparent from Table 2.

The above embodiments and examples given to illustrate the scope and spirit of the instant invention, make apparent, to those skilled in the art, other embodiments and examples. These other embodiments and examples are within the contemplation and scope of the present invention. Therefore, the present invention should be limited only by the appended claims.

What is claimed is:

1. A product of reaction useful for improving the low temperature characteristics of hydrocarbyl distillate fuels produced from the reaction of (1) an amide derivative of a branched chain monocarboxylic acid having at least one tertiary amine group, (2) an epoxide having from 2 to about 18 carbon atoms and (3) an additional carboxylic acid selected from branched chain monocarboxylic acids or linear monocarboxylic acids and wherein said reactants are reacted in substantially stoichiometric or equimolar amounts at temperatures ranging from about 50° to about 175° C. under autogenous pressure in 0.5 to about 3 hours or more.

2. The reaction product of claim 1 wherein said amide has the following generalized structure $$R^2CON(R^3)R^4N(R^5)(R^6)$$

where $R^2$ is a branched chain monocarboxylic acid radical having a molecular weight of from about 300 to about 1,000, $R^3$ is hydrogen or $C_1$–$C_{10}$ alkyl, $R^4$ is $C_1$–$C_{25}$ hydrocarbyl and $R^5$ and $R^6$ are the same or different and are $C_1$–$C_{25}$ alkyl.

3. The reaction product in accordance with claim 2 wherein said branched chain monocarboxylic acid is a telomer acid in which at least a portion of said telomer acid has the following generalized structural formula

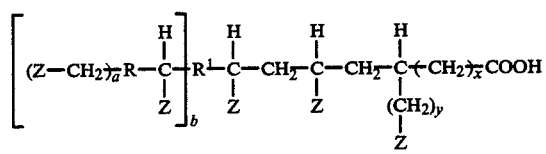

where Z is $-(CH_2)_nCH_3$; n is an integer of from 3 to 42; x and y are different and are 0 or 2; a is 0 or 1; if a is 0, R is hydrogen but if a is 1, R is —$CH_2$; and b is 0 or 1; if b is 0, $R^1$ is hydrogen but if b is 1, $R^1$ is —$CH_2$.

4. The reaction product in accordance with claim 1 wherein said additional carboxylic acid is a telomer branched chain carboxylic acid.

5. The reaction product in accordance with claim 4 wherein said carboxylic acid is the same telomer acid as said additional branched chain monocarboxylic acid.

6. An additive product useful for improving the low temperature characteristics of hydrocarbyl distillate fuels comprising the reaction product of (1) a branched chain monocarboxylic acid amide having the following generalized structure $$R^2CON(R^3)R^4N(R^5)(R^6)$$

where $R^2$ is a branched chain monocarboxylic telomer acid radical having a molecular weight of from about 300 to about 1,000, $R^3$ is hydrogen or $C_1$–$C_{10}$ alkyl, $R^4$ is $C_1$–$C_{25}$ hydrocarbyl and $R^5$ and $R^6$ are the same or different and are $C_1$–$C_{25}$ alkyl; (2) an epoxide having 2 to about 18 carbon atoms with (3) a carboxylic acid selected from branched chain monocarboxylic and linear monocarboxylic acids and wherein at least a portion of said telomer acid has the following generalized structural formula

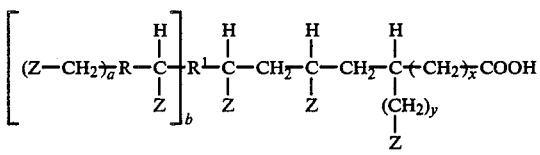

where Z is —$(CH_2)_nCH_3$; n is an integer of from 3 to 42; x and y are different and are 0 or 2; a is 0 or 1; if a is 0, R is hydrogen but if a is 1, R is —$CH_2$; and b is 0 or 1; if b is 0, $R^1$ is hydrogen but if b is 1, $R^1$ is —$CH_2$.

7. The additive product of claim 6 wherein said telomer acid is further identified as a $C_{18}$ telomer acid.

8. The additive product of claim 6 wherein said telomer acid is further identified as a $C_{10}$ telomer acid.

9. The additive product in accordance with claim 6 wherein said branched chain acid has at least one side chain of from about 8 to 18 carbon atoms.

10. The additive reaction product in accordance with claim 6 wherein said branched chain acid has at least one side chain having about 18 carbon atoms.

11. The reaction product of claim 1 wherein the epoxide reactant is selected from the group consisting essentially of propylene oxide, styrene oxide, 1,2-epoxybutane, a $C_{10}$ epoxide, a $C_{14}$ epoxide and a $C_{18}$ epoxide.

12. The reaction product of claim 1 wherein the amide is derived from an amine selected from the group comprising the following amines N-(3-aminopropyl)-morpholine, N-(2-aminoethyl)morpholine, N-(2-aminopropyl)morpholine, N,N'-bis(3-aminopropyl)piperazine, N,N-diethylethylenediamine, 3-dimethylaminopropylamine, unsymmetrical (unsym.) dimethylethylenediamine, N,N-dimethyl-N'-ethylethylenediamine and mixtures of two or more of these.

13. The reaction product of claim 12 wherein the amide is derived from the following amine: 3-dimethylaminoprylamine.

14. A distillate fuel composition comprising a major proportion of a hydrocarbyl distillate fuel and a minor cold flow improving amount of the additive reaction product defined in claim 1 effective to reduce the pour point and the Cold Filter Plugging Point of said fuel.

15. A distillate fuel composition comprising a major amount of a hydrocarbyl distillate fuel and a minor cold flow improving amount of the additive of claim 1.

16. A distillate fuel composition comprising a major proportion of a hydrocarbyl distillate fuel and a minor cold flow improving amount of the additive of claim 6.

17. A hydrocarbyl distillate fuel composition comprising a distillate fuel and between about 0.01 and 3% by weight, based on the total weight of the composition, of the additive of claim 1.

18. A hydrocarbyl distillate fuel composition comprising a distillate fuel and between about 0.01 and 3% by weight, based on the total weight of the composition, of the additive of claim 6.

19. A method for lowering the pour point and the CFPP of hydrocarbyl distillate fuels which comprises adding a minor pour point depressant and CFPP lowering amount of a product of reaction as defined in claim 1.

20. A method for lowering the pour point and the CFPP of hydrocarbyl distillate fuels which comprises adding a minor pour point depressant and CFPP lowering amount of a product of reaction as defined in claim 6.

* * * * *

UNITED STATES PATENT AND TRADEMARK OFFICE

CERTIFICATE OF CORRECTION

PATENT NO. : 4,657,562

DATED : April 14 , 1987

INVENTOR(S) : J. C. Axelrod and S. Chibnik

It is certified that error appears in the above-identified patent and that said Letters Patent is hereby corrected as shown below:

Col. 3, lines 27-30, delete second "→" and remaining formula thereafter.

Signed and Sealed this

Eighteenth Day of August, 1987

*Attest:*

DONALD J. QUIGG

*Attesting Officer*

*Commissioner of Patents and Trademarks*